US009036789B2

(12) United States Patent
Masaki et al.

(10) Patent No.: US 9,036,789 B2
(45) Date of Patent: May 19, 2015

(54) X-RAY APPARATUS AND ITS ADJUSTING METHOD

(71) Applicant: Canon Kabushiki Kaisha, Tokyo (JP)

(72) Inventors: Fumitaro Masaki, Irvine, CA (US); Naoya Iizuka, Utsunomiya (JP); Mitsuaki Amemiya, Saitama (JP); Akira Miyake, Nasukarasuyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 253 days.

(21) Appl. No.: 13/783,520

(22) Filed: Mar. 4, 2013

(65) Prior Publication Data

US 2013/0243163 A1 Sep. 19, 2013

(30) Foreign Application Priority Data

Mar. 13, 2012 (JP) ..... 2012-055716

(51) Int. Cl.
*G21K 1/06* (2006.01)

(52) U.S. Cl.
CPC ..... *G21K 1/062* (2013.01); *G21K 1/067* (2013.01); *G21K 1/06* (2013.01); *G21K 2201/064* (2013.01)

(58) Field of Classification Search
CPC ..... G21K 1/02; G21K 1/06; G21K 1/062; G21K 1/067; G21K 5/04; G21K 7/00; G21K 2201/06; G21K 2201/061; G21K 2201/064; G21K 2201/067
USPC ..... 378/147, 149
See application file for complete search history.

(56) References Cited

U.S. PATENT DOCUMENTS

| | | | | |
|---|---|---|---|---|
| 3,143,651 | A * | 8/1964 | Giacconi et al. | 378/43 |
| 5,001,737 | A * | 3/1991 | Lewis et al. | 378/147 |
| 5,192,869 | A * | 3/1993 | Kumakhov | 250/505.1 |
| 5,340,992 | A * | 8/1994 | Matsugu et al. | 250/548 |
| 5,570,408 | A | 10/1996 | Gibson | 378/145 |
| 6,266,392 | B1 | 7/2001 | Fujinawa et al. | 378/149 |
| 6,479,818 | B1 * | 11/2002 | McCarthy et al. | 250/310 |
| 7,158,608 | B2 * | 1/2007 | Kucharczyk | 378/71 |
| 7,397,900 | B2 * | 7/2008 | Papaioannou et al. | 378/147 |
| 2013/0243163 | A1 * | 9/2013 | Masaki et al. | 378/138 |

FOREIGN PATENT DOCUMENTS

| | | |
|---|---|---|
| JP | H10-508947 | 9/1998 |
| JP | 2000-137098 | 5/2000 |
| JP | 2004-89445 | 3/2004 |

OTHER PUBLICATIONS

U.S. Appl. No. 13/778,780, filed Feb. 27, 2013.
U.S. Appl. No. 13/785,178, filed Mar. 5, 2013.
U.S. Appl. No. 13/791,070, filed Mar. 8, 2013.

* cited by examiner

*Primary Examiner* — Thomas R Artman
(74) *Attorney, Agent, or Firm* — Fitzpatrick, Cella, Harper & Scinto

(57) ABSTRACT

An adjusting method of an X-ray apparatus has a reflection structure, wherein assuming that one end plane of the reflection structure is an inlet port of the X-ray and the other end plane is an outlet port of the X-ray, a pitch of the reflection substrates at the outlet port is wider than that at the inlet port. When the X-ray source exists at a position where a glancing angle at the time when the X-ray enters the inlet port exceeds a critical angle, an intensity of the X-ray emitted from each passage is detected. On the basis of the detected X-ray intensity, a relative position of the X-ray source and the reflection structure is adjusted.

7 Claims, 7 Drawing Sheets

X-RAY APPARATUS AND ITS ADJUSTING METHOD

BACKGROUND OF THE INVENTION

1. Field of the Invention

The present invention relates to an X-ray apparatus for irradiating an X-ray to an object (object to be radiographed) and, more particularly, to an X-ray apparatus in which a relative position of an X-ray source and a radiation element is optimized and an adjusting method of such an X-ray apparatus.

2. Description of the Related Art

Such a technique that an X-ray is one-dimensionally collimated by using a radiation element has been known. Japanese Patent Application Laid-Open No. 2000-137098 discloses solar slits having metal foils which are arranged on an X-ray radiation path and are laminated with an interval. Further, such a technique that a surface roughness is provided for the surface of the metal foil and a reflection of the X-ray is restricted, thereby forming a collimated X-ray beam has also been disclosed.

Japanese Patent Application Laid-Open No. 2004-89445 discloses such an X-ray generating apparatus that a collimator in which a plurality of micro capillaries are two-dimensionally arranged is combined with multiple X-ray sources arranged in a 2-dimensional lattice shape, thereby collimating the X-ray.

Japanese Patent Application Laid-Open No. H10-508947 discloses such a radiation system that a divergence X-ray appearing from an X-ray source having a small spot size is efficiently captured in a monolithic radiation element having a plurality of capillary tubes of hollow glass, thereby forming a pseudo collimated beam.

According to the radiation element disclosed in Japanese Patent Application Laid-Open No. 2000-137098, since only the collimated component of the X-ray is extracted, only an extremely minor part of the generated X-ray can be used and so use efficiency is low.

According to the radiation element disclosed in Japanese Patent Application Laid-Open No. 2004-89445, it is difficult to form the uniform capillaries. It is also difficult to two-dimensionally arrange the X-ray sources at a high density.

According to the radiation element disclosed in Japanese Patent Application No. H10-508947, since the capillary tubes of hollow glass are melted and molded together, it is difficult to form the uniform capillary tubes.

Therefore, a radiation element having such a simple structure that the generated X-ray is efficiently collimated and emitted is demanded.

In order to obtain the high-intensity X-ray and the high resolution, the relative position of the X-ray source and the radiation element is important. According to the technique disclosed in Japanese Patent Application Laid-Open No. 2000-137098, the alignment of the relative position of both of them is made so as to maximize the intensity of the X-ray which is transmitted through the solar slit. For example, in FIG. 10, when the X-ray source is moved in the y direction, if an X-ray source 1 exists within a range shown by broken lines, the intensity of the X-ray which is transmitted through a solar slit 31 becomes maximum and does not change. Since a magnitude of an angle width $\alpha$ hardly changes, an influence on the resolution of an image is also small. If the X-ray source 1 is out of the range of the broken lines, the intensity of the X-ray decreases. Therefore, such an alignment method that the intensity of the X-ray becomes maximum is used.

However, according to the foregoing alignment method, when the relative position of both of them is deviated from a design value, even if such a deviation is small and the decrease in intensity of the X-ray is not caused, there is a case where the resolution of the image decreases. Even in the other radiation elements in the related arts, according to the foregoing alignment method, there is a case where the resolution of the image deteriorates.

It is, therefore, an object of the invention to provide an X-ray apparatus in which a generated X-ray can be efficiently collimated and emitted by a simple structure and a best resolution of an image is obtained and to provide an adjusting method of such an X-ray apparatus.

SUMMARY OF THE INVENTION

To solve the above problem, according to an aspect of the present invention, an adjusting method of an X-ray apparatus comprises: an X-ray source; a reflection structure including at least three reflection substrates arranged at intervals so that X-rays are each incident into each of paths each of which both sides are defined by adjacent ones of the reflection substrates, and are reflected by the adjacent ones of the reflection substrates, to be collimated and emitted from the paths, wherein an inlet port for the X-ray is arranged at one end of the reflection structure, while an outlet port for the X-ray is arranged at the other end of the reflection structure, and an arrangement pitch of the reflection substrates at the outlet port is larger than an arrangement pitch of the reflection substrates at the inlet port, and wherein, when the X-ray source is positioned such that a glancing angle of X-ray incident in the inlet port is larger than a critical angle, an intensity of the X-ray emitted from the outlet port is measured, and based on the measured intensity of the X-ray, a relation between positions of the x-ray source and the reflection structure is adjusted.

According to the invention, the generated X-ray can be efficiently collimated by the simple structure. When the X-ray source exists at the position where the glancing angle at the time when the X-ray enters exceeds the critical angle, on the basis of the intensity of the X-ray which was emitted from each passage and was detected, the radiation source position where the best resolution of the image is obtained can be presumed. Therefore, the X-ray source and the reflection structure can be arranged so as to obtain the best resolution of the image.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

In the embodiment, a slit lens is used as an X-ray reflection structure of (hereinbelow, referred to as a reflection structure).

(1) Slit Lens

Figure 1:
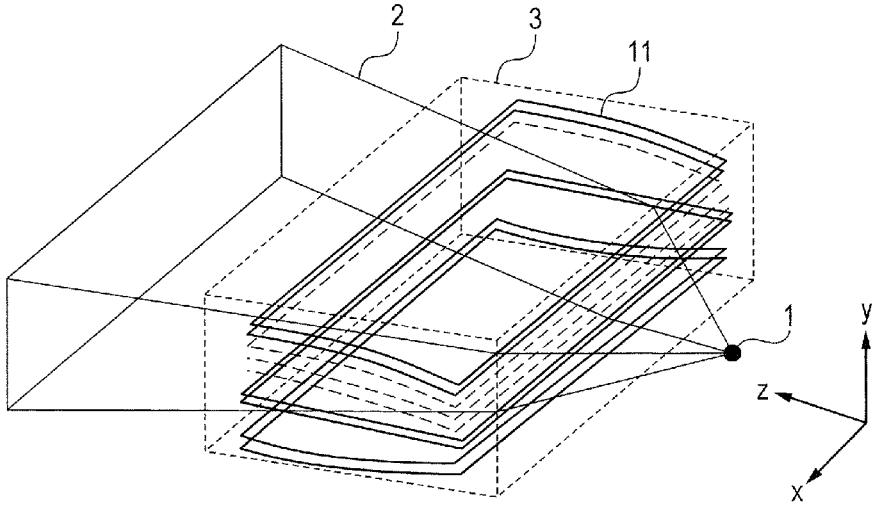
FIG. 1 is a schematic diagram illustrating an example of an X-ray radiographing apparatus according to the invention.

As illustrated in FIG. 1, a slit lens 3 has such a structure that at least three reflection substrates 11 for reflecting an X-ray are arranged with an interval. An interval between the adjacent reflection substrates is defined by a spacer or the like. An X-ray 2 which entered a plurality of passages in which both sides are sandwiched between the reflection substrates 11 is reflected by the reflection substrates 11 on both sides of each passage, is collimated, and is emitted from each passage. When assuming that one end plane of the slit lens 3 is an inlet port of the X-ray and the other end plane is an outlet port of the X-ray, a pitch of the reflection substrates 11 at the outlet port is wider than that at the inlet port. "collimate" in the invention denotes that a component of the X-ray in the laminating direction (y direction) of the reflection substrates 11 is decreased (i.e. "collimating parallel to xz plane") and an emitting direction of the X-ray is aligned with the surface (xz plane) perpendicular to the y direction.

(2) Resolution

Figure 2A:
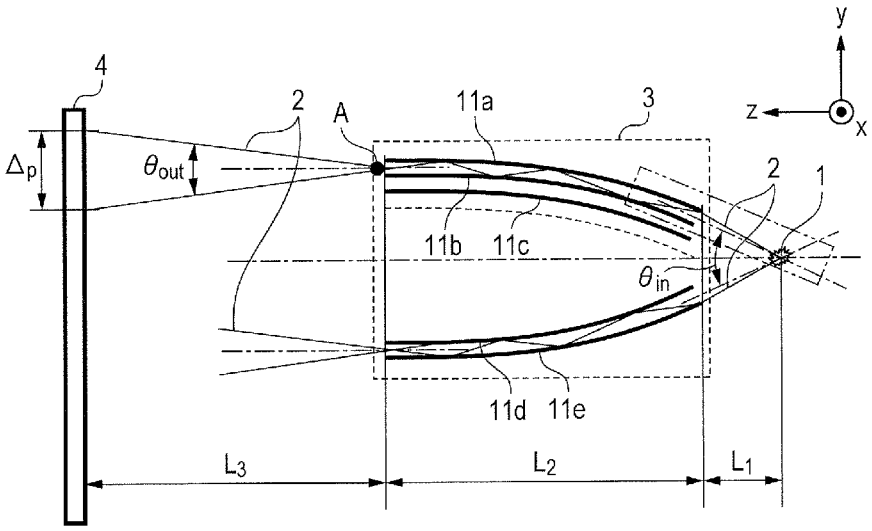
FIGS. 2A and 2B are schematic diagrams illustrating an example of a reflection structure according to the invention.

First, in an X-ray radiographing apparatus to which the invention has been applied, a penumbra quantity (resolution) which is obtained in the case where an X-ray which entered a passage of the slit lens 3 from the X-ray source 1 and was transmitted through the passage has been irradiated to a sample and a transmission image has been projected to an X-ray detector (hereinbelow, simply referred to as a detector) 4 will be described with reference to FIGS. 1 and 2A. FIG. 1 is a conceptual diagram of a collimating principle in the invention. FIG. 2A is a cross sectional view taken along a yz plane of the slit lens 3 in FIG. 1 which passes through the X-ray source 1.

Figure 2B:
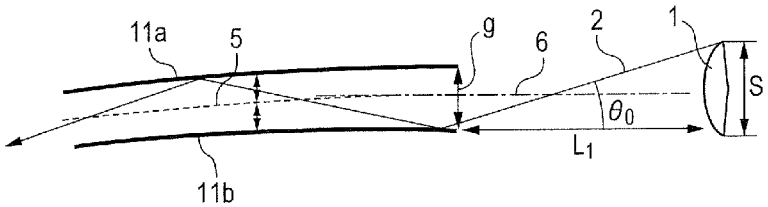

As illustrated in FIGS. 2A and 2B, when assuming that an infinite small object A exists at the outlet port of the slit lens 3 and a blur of the object A is defined as a penumbra quantity $\Delta_p$ of an image, the penumbra quantity $\Delta_p$ is expressed by the following equation (1) by using a divergence angle $\theta_{out}$ of the X-ray at the outlet port of the slit lens 3 and a distance $L_3$ in a facing direction of the outlet port of the slit lens 3 and the detector 4.

$$\Delta_p = L_3 \times \theta_{out} \quad (1)$$

The equation (1) is satisfied with respect to the X-ray which is emitted from each passage.

The larger the penumbra quantity $\Delta_p$ is, the lower the resolution of the X-ray radiographing apparatus is. Therefore, in order to raise the resolution, now assuming that $L_3$ is constant, it is important to decrease the divergence angle $\theta_{out}$, that is, to raise a collimation degree of the X-ray which is emitted from each passage of the slit lens 3.

The resolution of the X-ray radiographing apparatus is not determined only by the penumbra quantity $\Delta_p$ but is determined by a larger one of the penumbra quantity $\Delta_p$ and a pixel size $\Delta_d$ of the detector 4 (for example, flat panel detector (FPD) or the like). When the pixel size $\Delta_d$ is decreased, not only the detector 4 becomes expensive but also it takes a long data transfer processing time. On the other hand, in order to decrease the penumbra quantity $\Delta_p$, since it is necessary to reduce the source size of the X-ray source 1 or the like, a burden which is applied to a radiation system increases as will be described hereinafter. It is, therefore, important to obtain a balance between the pixel size $\Delta_d$ and the penumbra quantity $\Delta_p$. If it is assumed that a permissible range of a ratio between them is equal to 2 times, the following expression (2) is satisfied.

$$0.5 < \Delta_p / \Delta_d < 2 \quad (2)$$

(3) Collimating Principle

Subsequently, a principle (collimating principle) for collimating the X-ray which is emitted from each passage of the slit lens 3 will be described with reference to FIGS. 2A and 2B. FIG. 2B is an enlarged diagram of a region of the slit lens 3 in FIG. 2A surrounded by an alternate long and two-short dashes line. Although a thin glass substrate is used as a reflection substrate 11 hereinbelow, a metal or the like may be used.

As illustrated in FIG. 2A, the X-ray 2 emitted from the X-ray source 1 is divergent radiation and is irradiated in all directions. The slit lens 3 is arranged at a position which is away in the facing direction of the X-ray source 1 by a distance $L_1$. The slit lens 3 is constructed in such a manner that the thin glass substrates having a gentle curvature are arranged at a predetermined pitch with an interval and the pitch at the outlet port of the X-ray is wider than that at the inlet port of the X-ray. Here,"pitch" denotes a distance between the corresponding planes of the adjacent thin glass substrates. A thickness of one thin glass substrate is equal to 1 μm to 100 μm, 10 to 100 thin glass substrates are laminated, and the X-ray can be reflected by both planes. The X-ray 2 which entered a passage between thin glass substrates 11*a* and 11*b* progresses while being reflected by both of the thin glass substrates 11*a* and 11*b* and is emitted from the passage. Also in a passage between thin glass substrates 11*b* and 11*c*, the X-ray 2 which has entered the passage similarly progresses while being reflected by both of the thin glass substrates 11*b* and 11*c* and is emitted from the passage. This is true also of the passages between other adjacent thin glass substrates. Although most of the X-ray 2 which enters each passage is collimated as mentioned above, among the X-rays 2 which enter the respective passages, the X-ray which progresses in the collimating direction is not reflected by the thin glass substrates but is emitted as it is from each passage.

As mentioned above, while the X-ray progresses in the passage of the slit lens 3, the X-ray whose progressing direction is not the collimating direction is reflected by the thin glass substrates a plurality of times, the progressing direction gradually approaches the collimating direction, and the X-ray is collimated and is emitted from each passage. Therefore, the X-ray can be efficiently collimated and emitted by a simple structure. Thus, the penumbra quantity $\Delta_p$ which is formed in the detector 4 also decreases.

Now, a virtual plane 5 is disposed at a position which is away from the thin glass substrates on both sides of the passage by an equal distance, and a tangent plane 6 of the virtual plane 5 is presumed at the inlet port of the slit lens 3. If the X-ray source 1 is located on the tangent planes at the inlet port side of a plurality of virtual planes 5, such a construction is desirable in terms of a point that the larger number of X-rays can be allowed to enter the respective passages. If all of the tangent planes 6 at the inlet port side of the plurality of virtual planes 5 formed between the adjacent thin glass substrates cross on a common straight line and the X-ray source 1 is located on the straight line as illustrated in FIGS. 2A and 2B, such a construction is desirable in terms of a point that a size of the X-ray source 1 can be reduced. If the thin glass substrates are collimated at the outlet port of the slit lens 3, that is, the tangent planes 6 at the outlet port side of the plurality of virtual planes 5 are almost parallel, such a construction is desirable in terms of a point that the collimation degree of the X-rays which are emitted from the respective passages can be raised.

Figure 3:
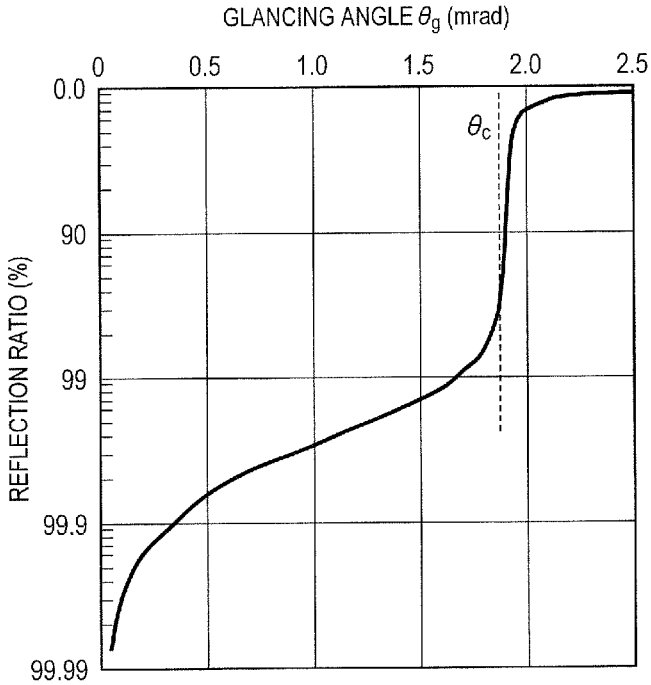
FIG. 3 is a graph illustrating a reflection ratio of an X-ray of a quartz substrate.

FIG. 3 illustrates an X-ray reflection ratio of the quartz substrate to the X-ray having a wavelength of 0.071 nm. An axis of abscissa indicates a glancing angle $\theta_g$ at the time when the X-ray enters each passage. An axis of ordinate indicates the reflection ratio of the X-ray. When the glancing angle $\theta_g$=0.5 mrad, the X-ray reflection ratio is equal to or larger than 99.8%. Therefore, it will be understood that when the X-ray is reflected 50 times, the X-ray of 90% or more is transmitted. From FIG. 3, it will be understood that although the X-ray reflection ratio is abruptly attenuated at the glancing angle $\theta_g$=1.8 mrad, the glancing angle $\theta_g$ at this time is called "critical angle" and is expressed by $\theta_c$. When the X-ray source 1 is located on the tangent planes at the inlet port side of the plurality of virtual planes 5, if an angle deviation of each tangent plane 6 is large, an angle deviation of each thin glass substrate where the X-ray source 1 is subtended occurs. The X-ray 2 emitted from the X-ray source 1 at the position where the glancing angle $\theta_g$ is larger than the critical angle $\theta_c$ is not reflected by the thin glass substrates. Therefore, it is necessary that a distance $\Delta_s$ in the direction perpendicular to the facing direction of the X-ray source 1 and the passage satisfies the following relation (3) by using the distance $L_1$ in the facing direction of the X-ray source 1 and the inlet port of the slit lens 3 and the critical angle $\theta_c$ of the glancing angle $\theta_g$ at the time when the X-ray enters each passage.

$$\Delta_s<L_1\times\theta_c \tag{3}$$

That is, it is necessary to decide the relative position of the slit lens 3 and the X-ray source 1 and the relative position of the thin glass substrate and the X-ray source 1.

Such a slit lens 3 that the interval between the adjacent thin glass substrates is constant and the thicknesses of all of the thin glass substrates at the outlet port side are thicker than those at the inlet port side is now considered. Such a slit lens 3 can be formed by laminating the thin glass substrates having a wedge-shaped thickness. A maximum glancing angle $\theta_{gmax}$ at the time when the X-ray enters each passage and is reflected by the thin glass substrates is obtained by the following equation (4).

$$\theta_{gmax}=(s+g)/2L_1 \tag{4}$$

where, s denotes a source size of the X-ray source 1 (diameter of the radiation source) and it is assumed that s=2σ in the case where intensity distribution of the radiation source can be approximated to Gaussian distribution. g indicates an interval between the adjacent thin glass substrates. However, $\theta_{gmax}$ has to be smaller than the critical angle $\theta_c$.

When the thin glass substrates are collimated at the outlet port side of the slit lens 3, a divergence angle $\theta_{out}$ of the X-ray which is emitted from each passage of the slit lens 3 is obtained by the following equation (5).

$$\theta_{out}=2\times\theta_{gmax} \tag{5}$$

At this time, the penumbra quantity $\Delta_p$ is obtained by the following equation (6) from the above equations (1), (4) and (5).

$$\Delta_p=L_3\times(s+g)/L_1 \tag{6}$$

The following relation (7) is obtained from the above expression (2) and the above equation (6).

$$0.5\times\Delta_d<L_3\times(s+g)/L_1<2\times\Delta_d \tag{7}$$

When the collimation degree of the thin glass substrates decreases, the X-ray does not reach the pixel of the detector 4 for detecting the intensity of the X-ray or the pixel in which the intensity of the X-ray is extremely low occurs. Therefore, it is necessary that a collimation degree $\Delta_{out}$ of all of the thin glass substrates satisfies a larger one of a permissible value $\Delta_{out\text{-}a}$ of the following expression (8a) and a permissible value $\Delta_{out\text{-}b}$ of the following expression (8b). It is now assumed that $\Delta_d$ indicates the pixel size of the detector 4.

$$\Delta_{out\text{-}a}<(s+g)/L_1 \tag{8a}$$

$$\Delta_{out\text{-}b}<\Delta_d/L_3 \tag{8b}$$

Figure 4:
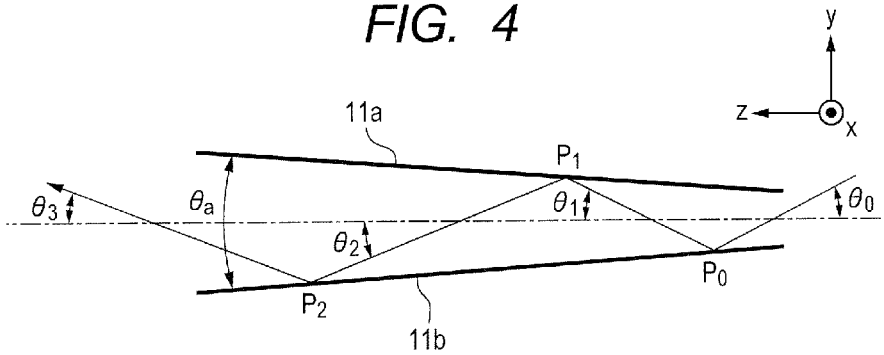
FIG. 4 is a schematic diagram illustrating another example of the reflection structure according to the invention.

Subsequently, such a slit lens 3 that the thicknesses of all of the thin glass substrates are constant and the interval between the adjacent thin glass substrates at the outlet port side is wider than that at the inlet port side is now considered. For simplicity of description, a case of a straight tube in which an angle defined between the thin glass substrates 11*a* and 11*b* is equal to $\theta_a$ as illustrated in FIG. 4 is now considered. When an angle defined between the virtual plane 5 and the X-ray 2 is a half divergence angle, it is assumed that the X-ray which entered the passage between the thin glass substrates 11*a* and 11*b* at a half divergence angle $\theta_0$ ($0.5\times\theta_a<\theta_0<\theta_c$) is reflected at a point $P_0$ of the thin glass substrate 11*b* and, after that, it is reflected at a point $P_1$ of the thin glass substrate 11*a*. A half divergence angle $\theta_1$ after the reflection of the first time is obtained by the following equation (9).

$$\theta_1=\theta_0-\theta_a \tag{9}$$

Therefore, an angle $\theta_n$ after the reflection of the nth time is obtained by the following equation (10) so as to lie within a range of $\theta_0-n\times\theta_a>0$.

$$\theta_n=\theta_0-n\times\theta_a \tag{10}$$

When $\theta_a<0.5\times\theta_a$, since the X-ray 2 does not reach the thin glass substrate, the half divergence angle does not change. Now, assuming that an interval between the adjacent thin glass substrates at the outlet port side is set to $g_{out}$, an interval between the adjacent thin glass substrates at the inlet port side is set to $g_{in}$, and a length of the thin glass substrate is set to $L_2$, an angle $\theta_a$ is obtained by the following equation (11).

$$\theta_a=(g_{out}-g_{in})/L_2 \tag{11}$$

At this time, since $\theta_a<\theta_{out}$, the penumbra quantity $\Delta_p$ is obtained by the following expression (12) from the foregoing equations (1) and (11).

$$(g_{out}-g_{in})\times L_3/L_2<\Delta_p \tag{12}$$

From the expressions (2) and (12), the following expression (13) is obtained.

$$0.5\times\Delta_d<L_3\times(g_{out}-g_{in})/L_2<2\times\Delta_d \tag{13}$$

From the same reason as that in the slit lens 3 having the construction illustrated in FIGS. 2A and 2B mentioned above, even in such a slit lens 3 that the thicknesses of all of the thin glass substrates are constant and the interval between the adjacent thin glass substrates at the outlet port side is wider than that at the inlet port side, it is desirable that the thin glass substrates are collimated at the outlet port of the slit lens 3. Therefore, it is necessary that the collimation degree $\Delta_{out}$ of all of the thin glass substrates satisfies a larger one of the permissible value $\Delta_{out-a}$ of the following expression (14a) and the permissible value $\Delta_{out-b}$ of the following expression (14b). It is now assumed that $\Delta_d$ indicates the pixel size of the detector 4.

$$\Delta_{out-a}<(g_{out}-g_{in})/L_2 \quad (14a)$$

$$\Delta_{out-b}<\Delta_d/L_3 \quad (14b)$$

A penumbra quantity $\Delta_x$ in such dimensions that the thin glass substrates do not have a curvature, that is, in the direction (x direction) perpendicular to both of the facing direction of the X-ray source 1 and the slit lens 3 and the direction perpendicular to the facing direction of the X-ray source 1 and the passage is obtained by the following equation (15).

$$\Delta_x=s\times L_3/(L_2+L_1) \quad (15)$$

The penumbra quantity $\Delta_x$ is determined by the relative position of the slit lens 3, the X-ray source 1, and the detector 4.

Such a slit lens 3 that the X-ray source 1 is located on the tangent planes at the inlet port side of the plurality of virtual planes 5 and the tangent planes at the outlet port side of the plurality of virtual planes cross on a common straight line can be also applied to the invention. Also in such a construction, the collimation can be realized. If all of the tangent planes 6 at the inlet port side of the plurality of virtual planes 5 cross on a common straight line and the X-ray source 1 is located on the straight line, such a construction is desirable in terms of a point that the source size of the X-ray source 1 can be reduced. In this case, the common straight line on which the tangent planes cross at the inlet port side is another straight line different from the common straight line on which the tangent planes cross at the outlet port side.

Subsequently, an exemplary embodiment of an X-ray apparatus according to the invention and an adjusting method of such an apparatus will be described.

First Embodiment

As illustrated in FIGS. 2A and 2B, the slit lens 3 which is used in the embodiment is constructed in such a manner that the interval g between the adjacent thin glass substrates is equal to 10 μm and is constant, the thicknesses of all of the thin glass substrates at the outlet port side are equal to 20 μm, and those at the inlet port side are equal to 10 μm. The FPD is used as a detector 4.

The X-ray 2 emitted from the X-ray source 1 enters the passage between the thin glass substrates ll*a* and 11*b* and progresses while being reflected by both of the thin glass substrates 11*a* and 11*b*. This is true also of the passages between other thin glass substrates. Although a solid angle $\Omega_1$ of the X-ray which enters one passage is proportional to the interval g, since the plurality of thin glass substrates are arranged with interval g, even if the interval g is reduced, the quantity of the X-ray which can be fetched as a whole is proportional to a divergence angle $\theta_{in}$ and a numerical aperture. Here, "numerical aperture" denotes a ratio at which the interval occupies at the inlet port of the slit lens 3. In the present embodiment, the numerical aperture is equal to 50% (=10 μm/(10 μm+10 μm)). The X-ray corresponding to 50% of the X-ray 2 emitted from the X-ray source 1 at the divergence angle $\theta_{in}$ or less enters the passage, progresses while being reflected by the thin glass substrates, and is emitted from the passage at the divergence angle $\theta_{out}$. An image of an object put between the outlet port of the slit lens 3 and the FPD is projected onto the FPD. At this time, the penumbra quantity $\Delta_p$ of the object image is formed on the FPD in accordance with the equation (1), so that in other words, a deterioration in resolution occurs.

A method of suppressing the deterioration in resolution to a value within a predetermined range will now be described. Since the penumbra quantity $\Delta_p$ can be expressed as shown by the equation (6), the source size s of the X-ray source 1 is obtained by the following expression (16) from the expression (2) and the equation (6).

$$0.5\times L_1/L_3\times\Delta_d-g<s<2\times L_1/L_3\times\Delta_d-g \quad (16)$$

When the distance $L_1$ in the facing direction of the X-ray source 1 and the inlet port of the slit lens 3 is equal to ($L_1$=100 mm), the distance $L_3$ in the facing direction of the outlet port of the slit lens 3 and the FPD is equal to ($L_3$=200 mm), and the pixel size $\Delta_d$ of the FPD is equal to ($\Delta_d$=100 μm), a permissible range of the source size s is equal to 15 μm<s<90 μm. It is sufficient to adjust the source size s so as to lie within such a range.

From the equation (15), when the length $L_2$ of the slit lens 3 is equal to ($L_2$=100 mm) and the source size s is equal to (s=90 μm), the penumbra quantity $\Delta_x$ is equal to 90 μm and is almost equal to the pixel size $\Delta_d$ of the FPD.

Therefore, as a resolution in the direction perpendicular to both of the facing direction of the X-ray source 1 and the inlet port of the slit lens 3 and the direction perpendicular to the facing direction of the X-ray source 1 and the passage, a resolution which is almost equal to the resolution in the facing direction of the X-ray source 1 and the inlet port of the slit lens 3 is obtained. Therefore, the X-ray can be efficiently collimated and emitted by the simple structure and the deterioration in resolution can be suppressed to a value within a predetermined range.

Figure 5:
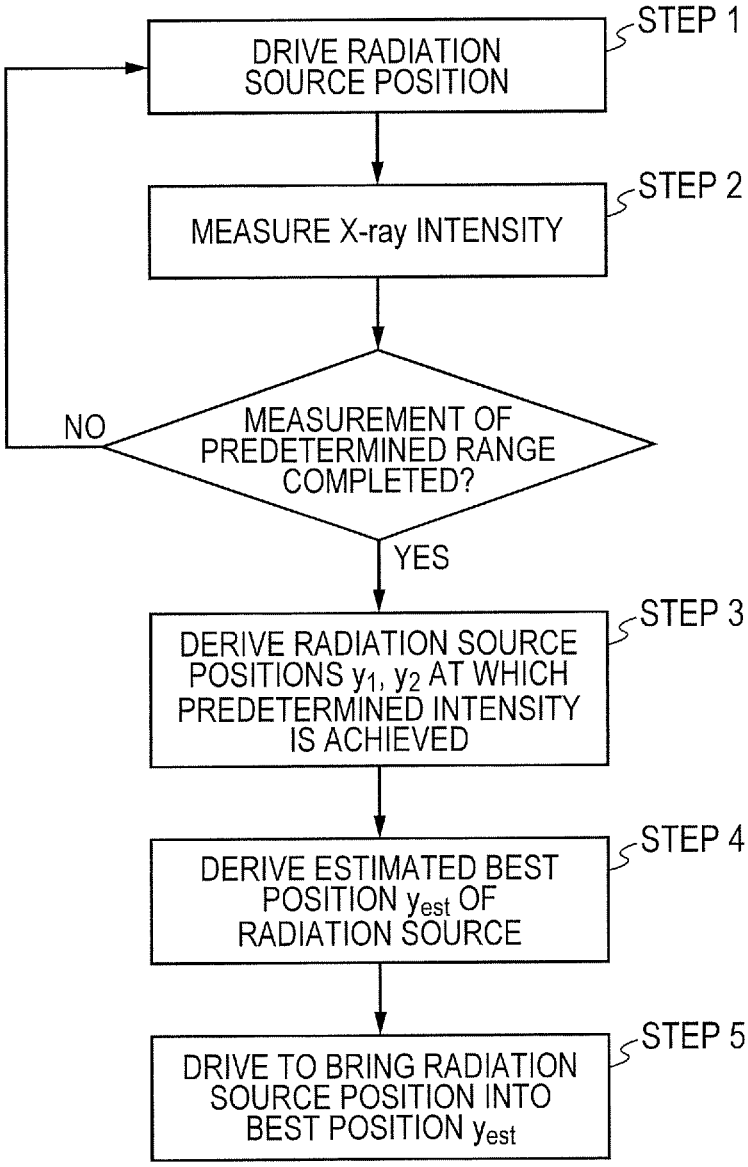
FIG. 5 is a flowchart of an adjusting method of an X-ray apparatus according to the invention.
Figure 6A:
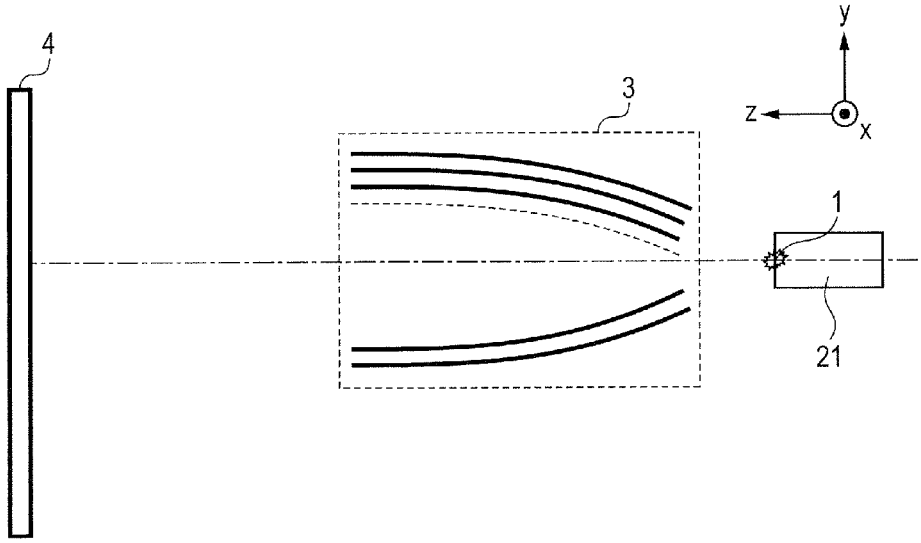
FIGS. 6A and 6B are schematic diagrams illustrating an example of the X-ray apparatus according to the invention.
Figure 6B:
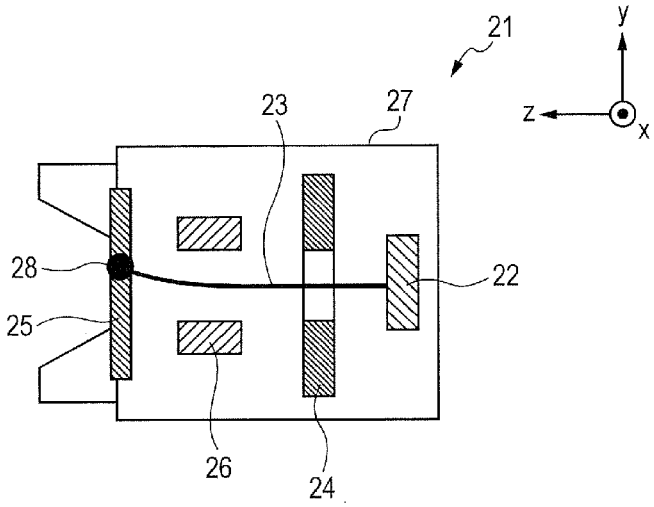

An alignment of the relative position of the X-ray source 1 and the slit lens 3 in the case where the source size s is set to 100 μm will now be considered. FIG. 5 shows a flowchart of an adjusting method of the X-ray apparatus according to the invention. FIG. 6A illustrates an example of the X-ray apparatus of the invention. FIG. 6B illustrates an example of a radiation source position driving mechanism 21 in FIG. 6A. As illustrated in FIG. 6B, according to the radiation source position driving mechanism 21, an electron beam 23 which is irradiated to a transmission target 25 is deflected by an electric field, thereby changing a radiation source position 28. An electron beam source 22, an electron lens 24 (lens electrode) for converging the electron beam 23, the transmission target 25 for generating an X-ray, and a deflector 26 for deflecting the electron beam 23 are arranged in a vacuum container 27. An electron pulled out of the electron beam source 22 is converged by the electron lens 24 and enters as an electron beam 23 into the transmission target 25. When the electron beam 23 enters the transmission target 25, the X-ray is emitted from a plane of the target at the side opposite to a plane where the electron beam 23 entered. Therefore, a position where the electron beam 23 entered the transmission target 25 becomes the radiation source position 28. At this time, by bending the electron beam 23 in the y direction by the deflector 26, the position of the electron beam 23 which enters the transmission target 25 is moved in the y direction, so that the radiation source position 28 can be moved in the y direction. By using such an X-ray source 1, the radiation source position 28 can be scanned by an electrical operation to the deflector 26.

Figure 7:
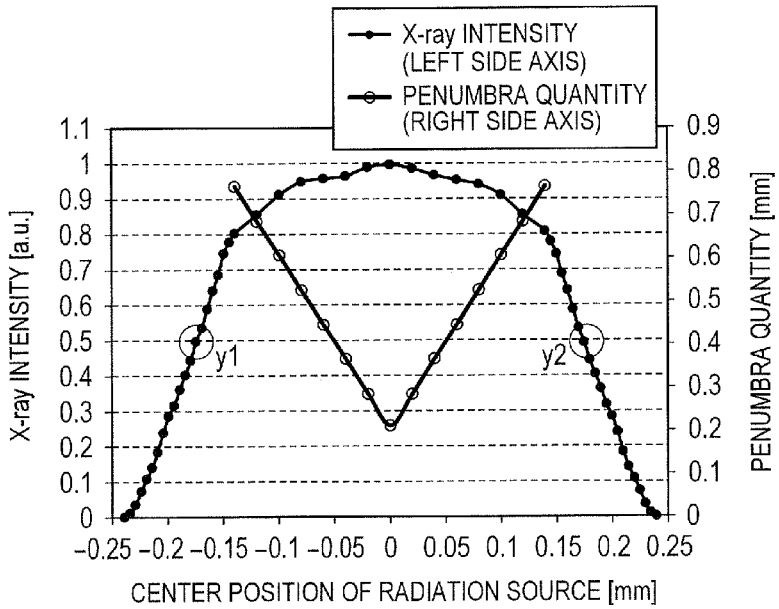
FIG. 7 is a graph illustrating a relation between a center position of a radiation source and an intensity of the X-ray and a relation between the radiation source center position and a penumbra quantity.

First, while the radiation source position 28 is moved in the y direction by the radiation source position driving mechanism 21, an intensity of the X-ray is measured (FIG. 5: steps 1 and 2). FIG. 7 illustrates a relation between a center position of the radiation source and the intensity of the X-ray which is detected by the detector 4 and a relation between the radiation source center position and the penumbra quantity $\Delta_p$ of the image which is formed on the detector 4 at this time. In FIG. 7, the radiation source center position is assumed to be the radiation source position 28 (position of the X-ray source 1) and the intensity of the X-ray which is detected is assumed to be a function of the radiation source center position at the time when the position of the slit lens 3 has been fixed. The penumbra quantity $\Delta_p$ is a quantity of the penumbra formed by the X-ray emitted from an arbitrary passage. A left side axis in FIG. 7 indicates the intensity of the X-ray which is detected by the detector 4 at the time when the radiation source position 28 has been driven. A right side axis in FIG. 7 indicates the quantity $\Delta_p$ of the penumbra formed on the detector 4 at the time when the radiation source position 28 has been driven. When the radiation source center position lies within a range from −0.15 mm to 0.15 mm, since the X-ray repeats the total reflection between the adjacent thin glass substrates, the intensity of the X-ray which is detected hardly changes. However, the penumbra quantity $\Delta_p$ increases depending on the radiation source position 28, that is, the resolution deteriorates.

On the other hand, it is an object of the alignment of the relative position of the X-ray source 1 and the slit lens 3 to minimize the quantity $\Delta_p$ of the penumbra which is formed on the detector 4, that is, to optimize the resolution. In the related art, since the alignment has been made by paying an attention to the intensity of the X-ray which is detected, for example, in the case where the detector 4 has noises of about 5%, there is a possibility that a radiation source position y_est where it is presumed that the resolution is best is equal to (y_est=0.06). The penumbra quantity $\Delta_p$ of the image when x=0.06 is equal to 0.44 mm and is larger than the minimum value by about two times.

Therefore, an attention is paid to a region where an absolute value of the radiation source position 28 exceeds 0.15 mm. The X-ray intensity in this region is an intensity of the X-ray which was emitted from each passage and detected when the X-ray source 1 exists at a position where the glancing angle at the time when the X-ray enters the inlet port of the slit lens 3 exceeds the critical angle. In this region, since the glancing angle of the X-ray between the thin glass substrates exceeds the critical angle, a reflection ratio decreases abruptly. Therefore, the intensity of the X-ray which is detected decreases abruptly. In the embodiment, the radiation source positions having the intensity of 50% of the maximum intensity are obtained by an interpolation and are assumed to be y1 and y2 (step 3). The presumed best radiation source position y_est is assumed to be an average position of y1 and y2 (step 4). The radiation source position 28 is moved to y_est (step 5) and the alignment is completed. In this case, even if the detector 4 has the noises of about 5%, an influence which is exerted on the radiation source position y_est that is caused by the noises is equal to about 0.005 mm. An increase in penumbra quantity $\Delta_p$ is settled to about 0.02 mm as compared with the minimum value. As mentioned above, according to the invention, the X-ray source 1 and the slit lens 3 are arranged on the basis of the intensity of the X-ray which is detected in the above region.

Although the radiation source position 28 having the intensity of 50% of the maximum intensity has been set to y1 and y2 in the embodiment, the intensity level of the X-ray of y1 and y2 is not limited to 50% so long as they are the radiation source position 28 having the same intensity. For example, the radiation source position 28 having the intensity of 80% of the maximum intensity may be set to y1 and y2. In this case, since a driving range of the radiation source position driving mechanism 21 can be narrowed, the alignment can be completed in a short time. There is also such an advantage that a stroke of the radiation source position driving mechanism 21 can be shortened. Although the radiation source position 28 has been changed by deflecting the electron beam 23 in the X-ray source in the embodiment, the X-ray source (radiation source main body) or the slit lens 3 may be driven.

Second Embodiment

Figure 8:
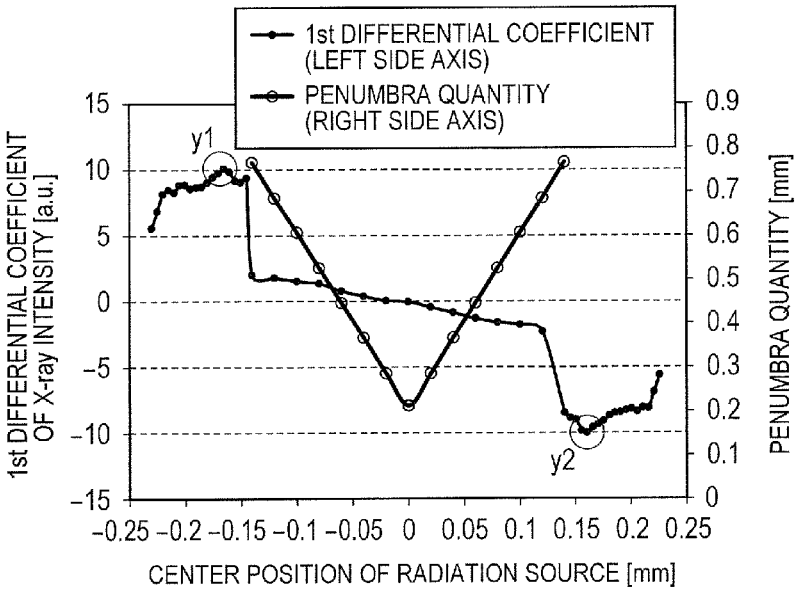
FIG. 8 is a graph illustrating a relation between the radiation source center position and a first differential coefficient of the X-ray intensity.

FIG. 8 illustrates a result in the case where the intensity of the X-ray which is detected is set to a function of the radiation source center position at the time when the position of the slit lens 3 has been fixed and a first differential coefficient of the intensity of the X-ray is obtained. In a manner similar to the first embodiment, the radiation source center position is set to the radiation source position 28 (position of the X-ray source 1). The embodiment differs from the first embodiment with respect to a point that y1 and y2 have been set to the radiation source positions where the first differential coefficient becomes maximum and minimum and the presumed best radiation source position y_est is set to the average position of y1 and y2. Although the differential coefficient in a region of −0.25 mm<y<0.25 mm has been illustrated in FIG. 8, there is no need to measure the whole region in order to obtain y1 and y2. It is sufficient to measure a region of −0.23 mm<y<−0.14 mm and a region of 0.14 mm<y<0.23 mm. In the first embodiment, since the position where the intensity of the X-ray which is detected becomes maximum is necessary, it is also necessary to measure a region of −0.14 mm<y<0.14 mm. However, in the second embodiment, since the necessary region can be narrowed, the alignment can be completed further in a short time. In the case where only the foregoing region was measured, since the measurement region can be narrowed by about 40%, a time necessary for the alignment can be also shortened to 40%.

Also in the embodiment, since an influence on the radiation source position y_est that is caused by the noises of the detector 4 is small in a manner similar to the first embodiment, the penumbra quantity $\Delta_p$ can be reduced.

Although the alignment has been made by using the radiation source positions where the first differential coefficient becomes maximum and minimum in the embodiment, the presumed best radiation source position may be derived from the radiation source position where the absolute value of the first differential coefficient is equal.

Third Embodiment

Figure 9:
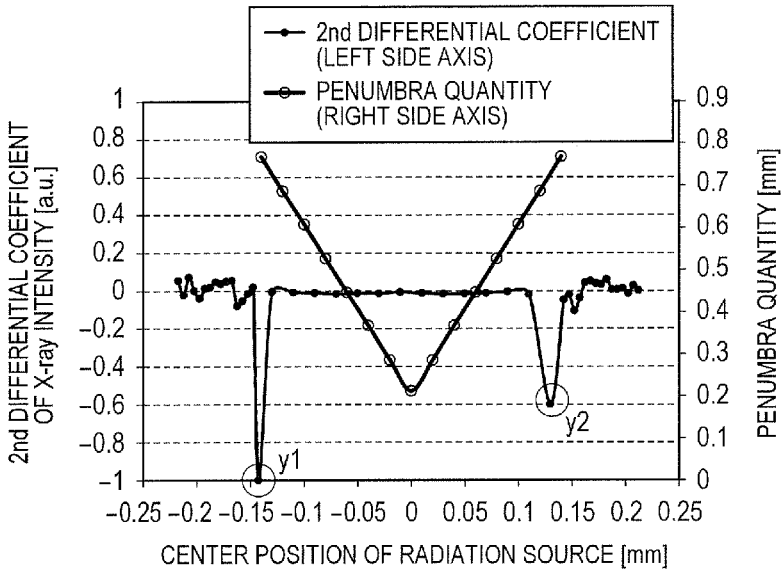
FIG. 9 is a graph illustrating a relation between the radiation source center position and a second differential coefficient of the X-ray intensity.
Figure 10:
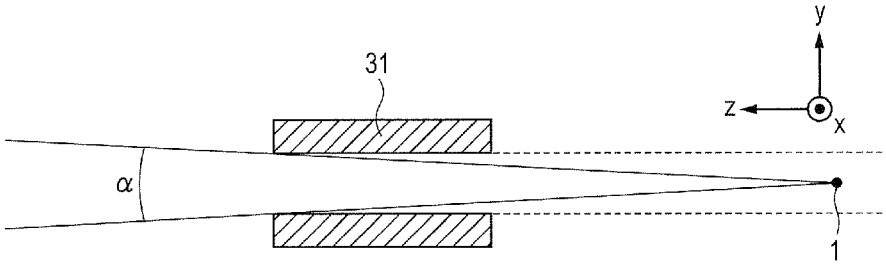
FIG. 10 is a schematic diagram illustrating a radiation element in the related art.

FIG. 9 illustrates a result in the case where the intensity of the X-ray which is detected is set to a function of the radiation source center position at the time when the position of the slit lens 3 has been fixed and a second differential coefficient of the intensity of the X-ray is obtained. In a manner similar to the first embodiment, the radiation source center position is set to the radiation source position 28 (position of the X-ray source 1). As will be understood from the position dependency of the first differential coefficient illustrated in FIG. 8, since the first differential coefficient changes largely before and after the position where the reflection angle of the X-ray in the slit lens 3 is equal to the critical angle, its feature appears remarkably in the second differential coefficient. The third embodiment differs from the first and second embodiments with respect to a point that y1 and y2 have been set to the radiation source positions where the second differential coefficient becomes a peak and the presumed best radiation source position y_est is set to the average position of y1 and y2. y1 and y2 can be sufficiently detected by measuring a region within a range of about 0.02 mm before and after the radiation source position at the time when the second differential coefficient becomes a peak. In this case, since the measurement region can be narrowed to ⅕ or less as compared with that in the first embodiment, a time necessary for the alignment can be also shortened to ⅕ or less.

Also in the third embodiment, since the influence on the radiation source position y_est that is caused by the noises of the detector 4 is small in a manner similar to the first and second embodiments, the penumbra quantity $\Delta_p$ can be reduced.

Although the alignment has been made by using the radiation source positions where the second differential coefficient becomes the peak in the embodiment, the presumed best radiation source position may be derived from the radiation source position where the absolute value of the second differential coefficient is equal. The presumed best radiation source position y_est may be derived by using a differential coefficient of a higher order.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-055716, filed Mar. 13, 2012, which is hereby incorporated by reference herein in its entirety.

What is claimed is:

1. An adjusting method of an X-ray apparatus that comprises:

an X-ray source;

a reflection structure including at least three reflection substrates arranged at intervals so that X-rays are each incident into each of paths each of which both sides are defined by adjacent ones of the reflection substrates, and are reflected by the adjacent ones of the reflection substrates, to be collimated and emitted from the paths, wherein an inlet port for the X-ray is arranged at one end of the reflection structure, while an outlet port for the X-ray is arranged at the other end of the reflection structure, and an arrangement pitch of the reflection substrates at the outlet port is larger than an arrangement pitch of the reflection substrates at the inlet port, wherein, when the X-ray source is positioned such that a glancing angle of X-ray incident in the inlet port is larger than a critical angle, an intensity of the X-ray emitted from the outlet port is measured, and based on the measured intensity of the X-ray, a relation between positions of the x-ray source and the reflection structure is adjusted, wherein when the position of the reflection structure is fixed, and the intensity of the X-ray is defined as a function of the position of the x-ray source, and wherein when the intensity of the X-ray at the X-ray source position y1 equals to the intensity of the X-ray at the X-ray source position y2, an average position between the X-ray source positions y1 and y2 is set as the position of the X-ray source.

2. The adjusting method according to claim 1, wherein the X-ray is generated by irradiating a target with an electron beam in the X-ray source, and the electron beam within the X-ray source is deflected to adjust the relation between positions of the x-ray source and the reflection structure.

3. The adjusting method according to claim 1, wherein the X-ray source is moved to adjust the relation between positions of the x-ray source and the reflection structure.

4. The adjusting method according to claim 1, wherein the reflection structure is moved to adjust the relation between positions of the x-ray source and the reflection structure.

5. An adjusting method of an X-ray apparatus that comprises:

an X-ray source;

a reflection structure including at least three reflection substrates arranged at intervals so that X-rays are each incident into each of paths each of which both sides are defined by adjacent ones of the reflection substrates, and are reflected by the adjacent ones of the reflection substrates, to be collimated and emitted from the paths, wherein an inlet port for the X-ray is arranged at one end of the reflection structure, while an outlet port for the X-ray is arranged at the other end of the reflection structure, and an arrangement pitch of the reflection substrates at the outlet port is larger than an arrangement pitch of the reflection substrates at the inlet port, wherein, when the X-ray source is positioned such that a glancing angle of X-ray incident in the inlet port is larger than a critical angle, an intensity of the X-ray emitted from the outlet port is measured, and based on the measured intensity of the X-ray, a relation between positions of the x-ray source and the reflection structure is adjusted, wherein when the position of the reflection structure is fixed, and the intensity of the X-ray is defined as a function of the position of the x-ray source, and a $1^{st}$ differential coefficient of the function is calculated, and when the $1^{st}$ differential coefficient is maximum at the X-ray source position y1, while the $1^{st}$ differential coefficient is minimum at the X-ray source position y2, an average position between the X-ray source positions y1 and y2 is set as the position of the X-ray source.

6. An adjusting method of an X-ray apparatus that comprises:

an X-ray source;

a reflection structure including at least three reflection substrates arranged at intervals so that X-rays are each incident into each of paths each of which both sides are defined by adjacent ones of the reflection substrates, and are reflected by the adjacent ones of the reflection substrates, to be collimated and emitted from the paths, wherein an inlet port for the X-ray is arranged at one end of the reflection structure, while an outlet port for the X-ray is arranged at the other end of the reflection structure, and an arrangement pitch of the reflection substrates at the outlet port is larger than an arrangement pitch of the reflection substrates at the inlet port, wherein, when the X-ray source is positioned such that a glancing angle of X-ray incident in the inlet port is larger than a critical angle, an intensity of the X-ray emitted from the outlet port is measured, and based on the measured intensity of the X-ray, a relation between positions of the x-ray source and the reflection structure is adjusted, wherein when the position of the reflection structure is fixed, and the intensity of the X-ray is defined as a function of the position of the x-ray source, and a $2^{nd}$ differential coefficient of the function is calculated, and when the $2^{nd}$ differential coefficient has peaks at the X-ray source position y1 and at the X-ray source position y2, an average position between the X-ray source positions y1 and y2 is set as the position of the X-ray source.

7. An X-ray apparatus comprising:

an X-ray source;

a reflection structure including at least three reflection substrates arranged at intervals so that X-rays are each incident into each of paths each of which both sides are defined by adjacent ones of the reflection substrates, and are reflected by the adjacent ones of the reflection substrates, to be collimated and emitted from the paths, wherein an inlet port for the X-ray is arranged at one end of the reflection structure, while an outlet port for the X-ray is arranged at the other end of the reflection structure, and an arrangement pitch of the reflection substrates at the outlet port is larger than an arrangement pitch of the reflection substrates at the inlet port, wherein, when the X-ray source is positioned such that a glancing angle of X-ray incident in the inlet port is larger than a critical angle, the x-ray source and the reflection structure are positioned based on an intensity of the X-ray emitted from the outlet port, and wherein when the position of the reflection structure is fixed, and the intensity of the X-ray is defined as a function of the position of the x-ray source, and wherein when the intensity of the X-ray at the X-ray source position y1 equals to the intensity of the X-ray at the X-ray source position y2, an average position between the X-ray source positions y1 and y2 is set as the position of the X-ray source.

* * * * *